US005996860A

United States Patent [19]

Alley

[11] Patent Number: 5,996,860

[45] Date of Patent: Dec. 7, 1999

[54] MOMENTARY BUOYANT GATE SYSTEM

[76] Inventor: Kenneth A. Alley, 1103 N. Buck St., Millville, N.J. 08332

[21] Appl. No.: 08/881,181

[22] Filed: Jun. 23, 1997

[51] Int. Cl.[6] ..... B67D 3/00; B65D 5/72; B65D 47/00

[52] U.S. Cl. ..... 222/564; 222/500; 222/547; 222/477; 222/495

[58] Field of Search ..... 222/564, 500, 222/547, 495, 477

[56] References Cited

U.S. PATENT DOCUMENTS

| | | | |
|---|---|---|---|
| 3,344,963 | 10/1967 | Wynes et al. | 222/495 |
| 3,794,202 | 2/1974 | Unger | 222/500 |
| 4,741,448 | 5/1988 | Alley et al. | 222/477 |
| 5,566,866 | 10/1996 | Jacobsen et al. | 222/495 |

*Primary Examiner*—Andres Kashnikow
*Assistant Examiner*—Keats Quinalty
*Attorney, Agent, or Firm*—Frank M. Linguiti

[57] ABSTRACT

A novel fluid container system comprises a container having a port at an upper end through which port fluid is permitted to pass for emptying the container. A restricter is provided within the container for momentarily restricting fluid flow out of the port when the container is inverted, the restricter having a construction such that a restricted fluid flow is permitted through the port for a period of time when the container is inverted, after which period of time a substantially less restricted fluid flow is permitted through the port. A retainer retains the restricter in the vicinity of the port. The retainer is disposed on an inner surface of the upper end of the container and extends inwardly from the inner surface. The retainer can include a substantially horizontal arcuate member or a circular member. Furthermore, the retainer can comprise at least one vertical member wherein the vertical member includes an inwardly extending abutment for preventing the restricter from falling downwardly when the container is disposed in the upright position. The restricter includes a ball which is buoyant in the fluid, which ball has a diameter greater than a diameter of the container port wherein the restricter includes a device disposed on the inner surface of the container for preventing the ball from forming a fluid-tight seal over the port.

38 Claims, 4 Drawing Sheets

10
12
14
22
32
18
16
34
36
38
28
40
44
48
52
56
66
60
62

MOMENTARY BUOYANT GATE SYSTEM

BACKGROUND OF THE INVENTION

This invention relates generally to devices for controlling fluid flow from a bottle or other fluid container. More specifically, this invention relates to a momentary gate for restricting fluid flow through an upper container port when the container is inverted.

Many homes and commercial establishments are equipped with some type of fluid dispensing apparatus, such as an electric water cooler. For example, many modem offices are equipped with water dispensing devices to provide employees convenient access to hot and cold drinking water wherein control of fluid flow is required. Additionally, control of oil flowing from oil containers into gasoline engines is a very common problem.

Conventional water dispensing systems typically utilize a standard five gallon bottle having a bottle neck at its upper end which forms an outlet port for water stored inside. Before placing the bottle on the water dispenser, a seal over the port must be removed and the bottle must be simultaneously lifted and inverted to orient the bottle neck vertically downwardly and permit the gravitational flow of water into the dispenser. This is difficult because of the size and weight of the bottle.

A problem experienced by many users of water dispensing systems of this type involves spillage of water onto floors, carpets, walls, and furniture while the bottle is inverted before it is securely positioned on the water dispenser. Such spillage can pose a serious safety hazard in some instances, and can cause damage to property in the vicinity of the water dispenser.

Accordingly, there was a need for a device capable of restricting flow out of water bottles, oil containers or other fluid containers when they are inverted which would not interfere with normal flow of the fluid out of the container after the container was securely positioned where intended. Furthermore, such a flow restriction device was required to have characteristics that permitted an automatic release of the flow restriction, or alternatively permit manual disengagement of the outlet port occlusion. Additionally, a flow restriction device for use specifically with oil or water bottles is needed that can be adapted for use with existing receiving means, for example engines, reservoirs or water coolers. In order to be useful the restriction device was required to involve minimal expense for installation or modification.

Alternative systems have been developed to address this problem with water coolers. Several companies have developed caps that provided a moving plug within the cap either in an open or a closed position. In order to use this system the water cooler was required to have a special apparatus to retain the plug thus opening the container when seated on the cooler and closing the cap when pulled off the cooler. This system required a two piece cap along with a receiving apparatus in the cooler.

U.S. Pat. No. 4,741,448, issued to Kenneth A. Alley, provided a solution to these problems. In the system taught by Alley a momentary gate was provided for fluid containers that effectively restricted fluid flow through an upper container port as the container was inverted. The momentary gate was incorporated into a fluid container including a bottle having a tapered fluid port at an upper end through which fluid passed to fill or empty the container, and means within the bottle for momentarily restricting fluid flow out of the port when the bottle was inverted.

The restricting means taught by Alley had a construction such that if the bottle was filled with fluid in an upright position, the fluid was permitted free passage through the port until the bottle was substantially full if the restricting means was in the bottle during filling, although it was preferred that the bottle be filled without the restricting means. When the bottle was substantially full the port was substantially occluded by the restricting means. When the bottle was inverted, some passage of fluid was permitted past the restricting means. However the port remained substantially occluded until either the fluid pressure at the port reduced sufficiently for the restricting means to disengage and permit the fluid to flow without obstruction through the port or until the bottle means was given an exterior blow.

In a preferred form of the system taught by Alley, the fluid container was intended for use in connection with systems that required inverting a container to fill a reservoir with liquid such as oil entry ports for automobiles or with water conditioning units. Typical water conditioning units of this type had means for receiving and holding the fluid container in an inverted position thereon in order to permit gravitational flow of water into the interior of the water conditioning unit. Water placed within the conditioning unit in this manner could be dispensed on demand.

The water container of systems compatible with the restricting means taught by Alley included a standard cylindrical bottle that could have a tapered fluid port at an upper end through which fluid passed to fill or empty the container. The restricting means included a buoyant capsule having a diameter greater than the diameter of the tapered fluid port of the bottle. The restricting means further included a ridge which, in connection with the ball when positioned in engagement with the port to restrict flow therethrough, defined a fluid passageway to ensure leakage of fluid past the ball when the bottle was inverted.

The ball remained in place to substantially occlude the bottle port and restrict flow therethrough until the buoyant characteristics of the ball overcame the fluid pressure bearing downwardly on the ball and the frictional engagement between the ball and the bottle. When such a condition was reached, the ball floated upwardly through the water and thus permitted the fluid to flow with minimal obstruction through the port. This process occurred automatically over a short period of time after the bottle was inverted. Alternatively disengagement of the ball could be caused to occur immediately after the bottle was inverted by giving the bottle a sharp external blow. In the case of oil containers a squeeze and/or a releasing motion could be applied to the bottle.

SUMMARY

A novel fluid container system comprises a container having a port at an upper end through which port fluid is permitted to pass for filling and emptying the container. A restricter is provided within the container for momentarily restricting fluid flow out of the port when the container is inverted, the restricter having a construction such that a restricted fluid flow is permitted through the port for a period of time when the container is inverted, after which period of time a substantially less restricted fluid flow is permitted through the port. A retainer retains the restricter in the vicinity of the port. The retainer is disposed on an inner surface of the upper end of the container and extends inwardly from the inner surface. The retainer can include a substantially horizontal arcuate member or a circular member. Furthermore, the retainer can comprise at least one vertical member wherein the vertical member includes an inwardly extending abutment for preventing the restricter from falling downwardly when the container is disposed in the upright position. The restricter can include a ball which is buoyant in the fluid, which ball has a diameter greater than a diameter of the container port wherein the restricter includes means disposed on the inner surface of the container for preventing the ball from forming a fluid-tight seal over the port.

DETAILED DESCRIPTION OF THE INVENTION

Figure 1:
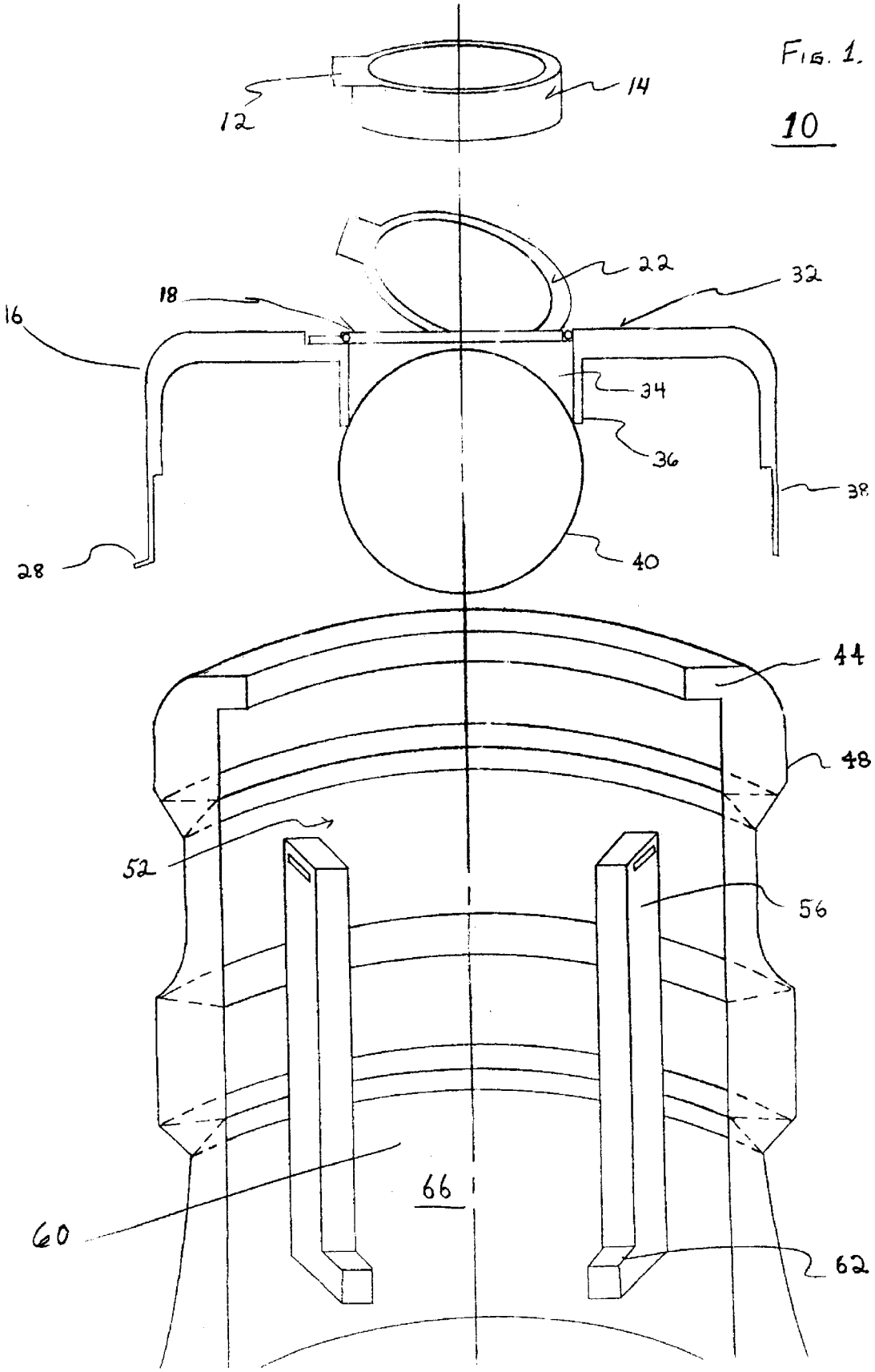
FIG. 1 shows the momentary buoyant gate system of the present invention.

Referring now to FIG. 1, there is shown momentary buoyant gate system 10 of the present invention. Momentary buoyant gate system 10 includes bottle throat 60 and buoyant capsule 40. Momentary buoyant gate system 10 can be used with any type of fluid container, for example container 66, wherein buoyant capsule 40 can function as a momentary buoyant gate. Momentary buoyant gate system 10 can serve as a safety device for preventing spills of fluid while inverting container 66 by providing a momentary gate that allows reaction time to prevent gross spillage of the fluid within container 66.

Momentary buoyant gate system 10 can be provided with cap 32. Cap 32 has a pull tab 22 which when pulled removes seal 18. Cap 32 has an injection molded tear away seal 18 which enables an operator to open the container without removing cap 32. Seal 18 can be designed to reseal the opening without using a separate plug 14. If desired a separate plug 14 can be provided with tab 12 to reseal cap 32.

Cap 32 serves as a means for closing container 66 and means for preventing buoyant capsule 40 from exiting through the exit port of container 66 when seal 18 is removed. Seal 18 is a physical barrier or closure that can be molded as part of cap 32 thus forming a closure within a closure. Cap 32 is the primary closure that remains on container 66 along with momentary buoyant gate system 10 during use of the product. Seal 18 is the secondary closure which can be removed by the user of the product. Plug 14 can be used to reseal if desired. Seal 18 can be designed to reseal if a one piece unit is desirable. Plug 14 can be molded to seal 18.

In the preferred embodiment of momentary buoyant gate system 10, cap 32 or secondary seal 18 is adapted to have an exit port diameter smaller than the diameter of buoyant capsule 40 in order to prevent buoyant capsule 40 from exiting container 66 by way of the exit port. In an alternate embodiment of momentary buoyant gate system 10, wherein the exit port is adapted to have an opening larger than the outer diameter of buoyant capsule 40, other means can be employed to prevent the escape of buoyant capsule 40.

Closure 32 can be a threaded closure to provide means for easy opening and closing of container 66. Pull tab 22 is provided to tear open secondary seal 18. Additionally, plug 14 can be threaded to fit into opening 34. Because of the presence of secondary seal 18 the primary seal or cap 32 does not have to be removed, thus encapsulating buoyant capsule 40 and providing an improved system both from an operating and a sanitary point of view.

Cap 32 can be a primary closure for a conventional five gallon water bottle container. Although a typical container closure does not provide a secondary closure, it does provide a peel tab to remove the closure in order to use the product. In this case secondary seal 18 that allows the user of momentary buoyant gate system 10 to use the product within container 66 without opening the primary seal cap 32 is provided. It will be understood that all of the momentary buoyant gate systems set forth herein can be used with containers of water, oil or any other fluid, although some systems may be better adapted for particular fluids according to the properties of the fluid and the needs of the user. It will also be understood that capsule 40 can also be buoyant in air, for example a helium balloon, in order to cause capsule 40 to always be at the highest point in the container. This may be desired to prevent escape of gases from a container and when converted the system may behave as a monumental buoyant gate only if desired.

Barrier 36 can comprise ridges 56 or other ridges including circular ridge means (not shown) that come into contact with buoyant capsule 40. The spaces or lack of a cohesive quality between ridges 56 when buoyant capsule 40 is in contact with them prevent a fluid tight seal and permit the passage of fluid to assure that momentary buoyant gate system 10 can function as set forth.

In addition to serving as a retaining means for preventing buoyant capsule 40 from forming a fluid tight seal the barrier serves as a port for container 66. Barrier 36 also prevents buoyant capsule 40 from exiting through the exit port by having a diameter smaller than that of buoyant capsule 40.

Feature 38 of cap 32 is the primary closure or perforated wall or inner wall adapted to tear under stress. Feature 38 includes pull tab 28 which provides means for removing primary closure 32 by a operator, while making it difficult for the product user or consumer to remove.

Lip portion 48 of a typical five gallon water bottle container 66 has inner diameter 44. The upper throat portion of container 66 has inner diameter 52. Inner diameter 52 of container 66 provides means to latch or lock an insert that can act as retaining means enclosed by bottle 66. Ridges 56 provided on the interior surface of the throat of container 66 can also vary the effective inner diameter of container 66, thus providing means to adjust the size of capsule 40 more accurately and control fluid flow through the throat of container 66. Ridges 56 also serve to guide buoyant capsule 40 to the exit port of container 66 when container 66 is inverted and guide buoyant capsule 40 toward the body of container 66 when container 66 is positioned upright.

The inner diameter of the throat of container 66 can also be adjusted by molding an extra thick wall uniformly around the interior of the throat. Ridges 56 also provide means to allow fluid to flow around buoyant capsule 40. Abutments 62 of ridges 56 prevent buoyant capsule 40 from exiting into the body of container 66. Capsule 40 should be given adequate clearance from the bottle inner wall in order to provide sufficient fluid flow around buoyant capsule 40. If sufficient clearance is not provided, there may be oscillation of the buoyant capsule 40 within the throat of bottle 66. Such oscillation may be desired.

Figure 2:
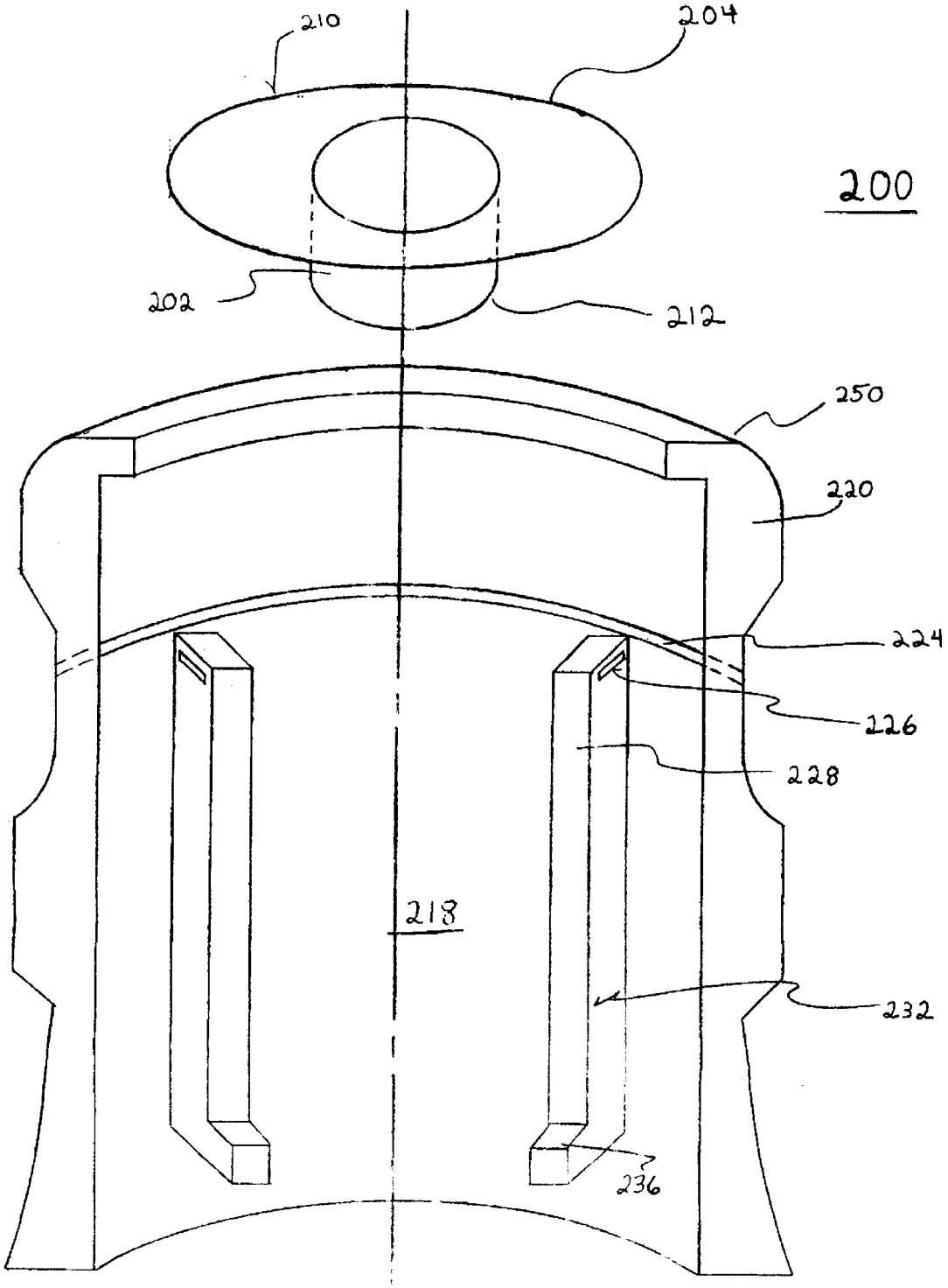
FIG. 2 shows an alternate embodiment of the momentary buoyant gate system of FIG. 1.

Referring now to FIG. 2, there is shown momentary buoyant gate system 200. Momentary buoyant gate system 200 includes insert 210 and bottle neck 250 for use with container 218. Insert 210 can be inserted within container 218 to restrict bottle neck 250 of container 218 and prevent buoyant capsule 40 from forming a fluid tight seal. Insert 210 also prevents buoyant capsule 40 from exiting bottle neck 250 as container 218 is inverted. Insert 210 provides the necessary restricting means for preventing buoyant capsule 40 from forming a fluid tight seal and allowing momentary buoyant gate system 200 to function without the use of a special closure.

Feature 204 is a physical barrier that provides means to prevent fluid within container 218 from passing through the opening of container 218 except at open center 202 of insert 210. Feature 204 can be provided with means for snapping or attaching to the inner wall of bottle lip 220, for example to features 224, 226. Open center 202 has a fluid passageway inner diameter that is smaller than the diameter of buoyant capsule 40 and of outer wall of container neck. This provides means for restricting the passage of buoyant capsule 40 through the exit port of container 218. Open center 202 is also the entry point of container 218 if desired for allowing fluid to pass into container 218 until container 218 is substantially full and buoyant capsule 40 rises up against the bottom edge 212 of restricting means 202. Insert 210 and capsule 40 can be put into the bottle after the bottle is filled. The container can be filled prior to placing capsule 40 therein.

Ridge means 212 or bottom edge 212 of insert 210 is the contact surface of the retaining means and is the portion of insert 210 where buoyant capsule 40 remains checked when bottle 218 is inverted. Buoyant capsule 40 remains checked in this position until its buoyancy overcomes other forces and it becomes dislodged. Thus insert 210 accomplishes the retaining means without the closure of retaining and/or restricting means 36. Another benefit of insert retaining and restricting means 210 is that the existing cap or closure of a typical five gallon water container can be used. Insert 210 can be snapped into position with snapping or latching means after buoyant gate 40 is placed into the bottle neck or upper portion of container 66.

FIG. 2 also shows a cross-sectional representation of bottle neck 250 of a typical five gallon container 218. Inner wall groove 224 can be provided to attach an insert, such as insert 210, to the inside of the neck of container 218. This allows the use of a standard closure thereby eliminating any need for a special closure.

Means 226 can also be provided for attaching insert 210 to bottle neck 250 of buoyant gate system 200. Means 226 thus can work in cooperation with attachment means 224 to assure that insert 210 does not come loose. Ridges 228 or vertical guides 228 or vertical rails 228 guide and contain buoyant capsule 40 and provide means for varying the inner diameter of container throat 250 with respect to the contact surface of buoyant capsule 40. Vertical rails 228 can be molded into the interior surface of container 218 or attached to container 218 after container 218 is formed. Vertical rails 228 also provide means for controlling the flow of fluid around buoyant capsule 40 that can be adjusted to control the rate of flow into and out of the port of container 218. Insert 210 can also be designed like a funnel to fit into existing bottles whereby the bottle interior wall applies enough friction to prevent the insert from escaping. This allows momentary buoyant gate systems, such as system 200, to be applied to existing bottles.

Vertical rails 228 can also be adjusted to control the frequency of the movement of buoyant capsule 40 within momentary buoyant gate system 200, thereby providing a cycling gate with a controllable frequency. For instance, if the flow around buoyant capsule 40 is minimal and buoyant capsule 40 is close enough to the exit port or restricting means and the viscosity of the fluid is ideal, momentary buoyant gate system 200 can function at a determined frequency to dispense fluids in predetermined intervals.

Vertical rails 228 thus have a precise function and provide means to adjust the functioning of momentary buoyant gate system 200. The variables involved in this function include: liquid viscosity, the size of buoyant capsule 40, the inner diameter of bottle neck 250, the length of bottle neck 218, the length of vertical rails 228, the travel range of capsule 250 determined by abutments 236, the specific gravity of buoyant capsule 40 and the specific gravity of the liquid. The travel range of buoyant capsule 40 is extremely important if means to prevent buoyant capsule 40 from moving farther away from the exit port is incorporated.

The combined effects of these variables determine the functioning with respect to timing and flow rates. Using vertical rails 56, 228, momentary buoyant gate systems 10, 200 can be customized for each application for purposes of precision. Vertical rails 56, 228 may also provide means to control fluid flow into container 218 if desired.

Abutments 236 at the ends of vertical rails 228 prevent buoyant capsule 40 from traveling farther into container 218 when container 218 is inverted and buoyant force is applied to buoyant capsule 40, and prevents capsule 40 from moving downwardly into container 218 when container 218 is upright. Rails 28 also provide means to adjust travel range of buoyant capsule 40 which provides means to customize functions to various fluids or containers. Thickness 232 of rails 228 can be formed greater or smaller in order to vary the inner diameter of the throat of container 218 with respect to the contact surface of buoyant capsule 40.

Figure 3:
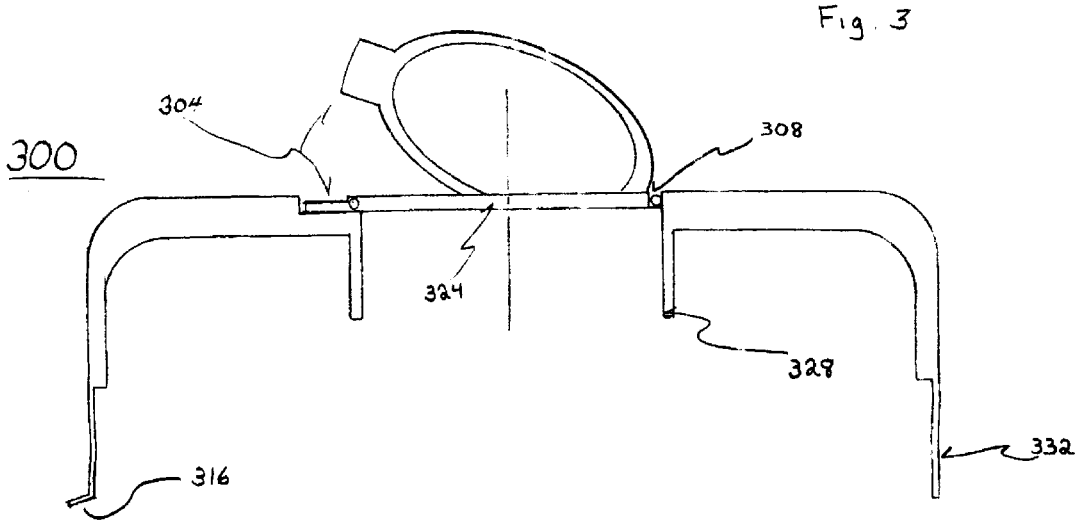
FIG. 3 shows a portion of an alternate embodiment of the momentary buoyant gate system of FIG. 1.
Figure 4:
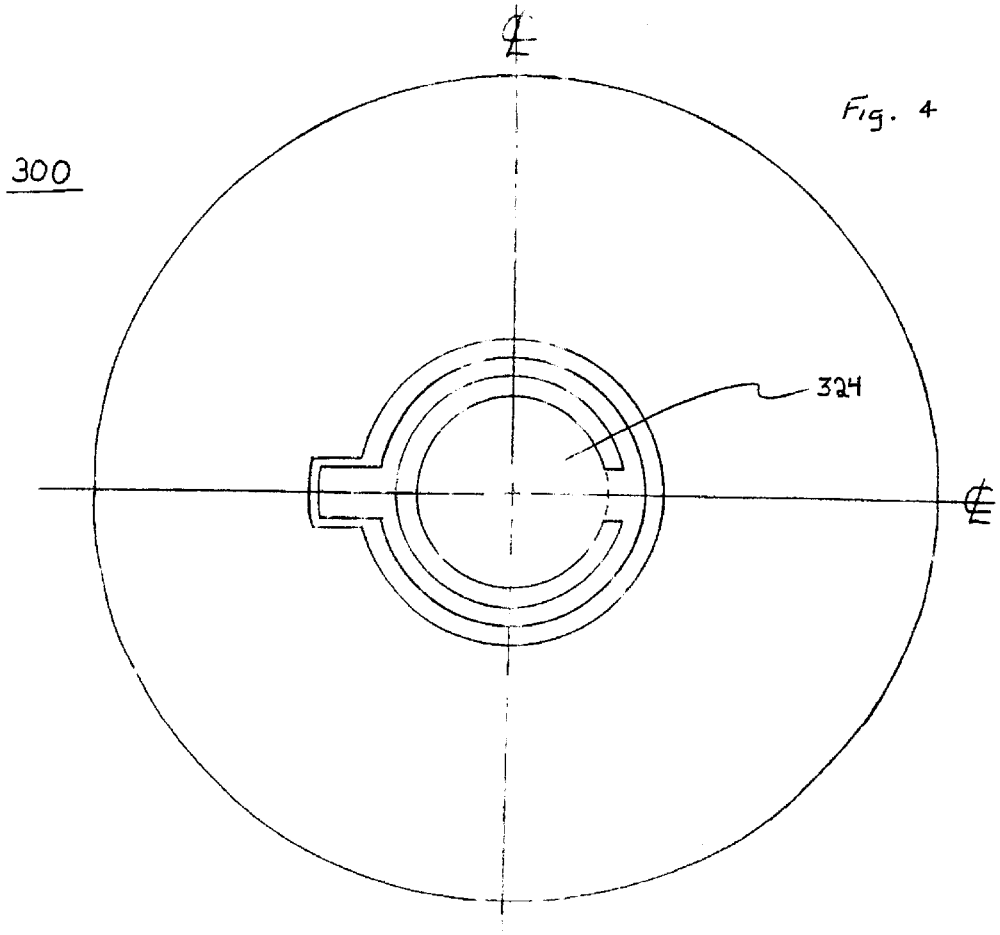
FIG. 4 shows a top view of the embodiment of FIG. 3.

Referring now to FIGS. 3, 4, there are shown cross-sectional and top views of closure system 300. Closure system 300 can be used in cooperation with momentary buoyant gate systems 10, 200 although closure system 300 is not needed when an insert is used. Acting in cooperation with closure system 300, a container port provides the retaining means necessary to prevent the escape of buoyant capsule 40 from a container such as containers 66, 218. Closure system 300 also controls the flow of liquid out of containers 66, 218 when containers 66, 218 are inverted.

It will be understood by those skilled in the art that for sanitary purposes in some applications it is desirable to provide users with limited access to the interior of containers 66, 218 when the product within containers 66, 218 is exhausted. Closure system 300 provides the limited access desired for this reason.

Secondary seal 324 is provided with closure system 300 for sealing containers 66, 218. Pull tab 304 is provided on secondary seal 324 of closure system 300 in order to permit a user to easily open secondary seal 324. Secondary seal 324 maybe provided with living hinge 308 to permit hinged opening. Living hinge 308 is the area of secondary seal 324 that begins to tear first when pull tab 304 is pulled upward by the user with sufficient force. Secondary seal 324 can be used to reseal containers 66, 218 by its design.

In an alternate embodiment secondary seal 324 can be a threaded seal in order permit reuse of closure system 300. Insert collar 328 or ridge means 328 is provided in closure system 300 in order to restrict the opening and prevent buoyant capsule 40 from exiting container 250. Ridge means 328 also provides means to control the flow rate of fluid with respect to the size of capsule 40 and the interior diameter of the throat of containers 66, 218 and also prevent a fluid tight seal.

Ridge means 328 thus represents a circular edge against which buoyant capsule 40 seats itself and remains in check when containers 66, 218 are inverted. By preventing a fluid tight seal, ridge means 328 allows buoyant capsule 40 to eventually dislodge and allow flow of fluid out of container 66. Tab 316 allows the manufacturer to remove the primary seal of closure system 300 while making it difficult for an end user to remove it. Feature 332 is a tapered wall which can be provided with a typical closure 300.

Figure 5:
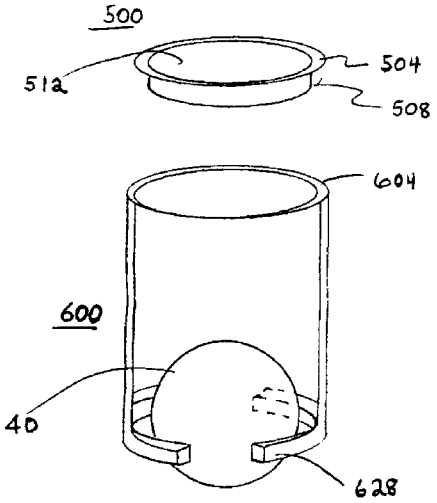
FIG. 5 shows a portion of an alternate embodiment of the momentary buoyant gate system of FIG. 1.

Referring now to FIG. 5, there is shown momentary buoyant gate insert 500 and container port 600. Momentary buoyant gate insert 500 provides restricting or retaining means for preventing buoyant capsule 40 from exiting a container when the container is inverted. The ridge of insert 500 also provides means for preventing a fluid tight seal. In the case of oil quarts a fluid tight seal may be desired although difficult to accomplish. Because of the resilient nature of an oil container, after the container is squeezed it can return to its original shape. When an oil container is squeezed buoyant capsule 40 is forced against the retaining means. When the squeezing pressure is released capsule 40 pops away from the retaining means and oil starts to seep, thus the buoyancy of permitting capsule 40 to take over. Insert 500 can also provide means for controlling the flow rate of fluid out of the container when the container is inverted.

Shoulder 504 seals against the top flange of the neck of a typical oil container. Shoulder 504 also provides the necessary surface for insert 500 to adhere to the top of a container. Insert 500 can be adhered in any method known, for example by using radio waves. Shoulder 504 may also have the necessary dimensions to fit inside a typical enclosure as a liner substitute when closure 500 is placed on a container.

Retaining means 508 of insert 500 controls the quality of the seal and prevents buoyant capsule 40 from escaping from a container. Retaining means 508 also provides means for controlling the flow rate of liquid escaping from a container by adjusting some of the variables set forth above.

Container port 600 encloses buoyant capsule 40 within its throat portion and includes horizontal arcuate means 628 to prevent buoyant capsule 40 from falling into the body of the container when the container is in an upright position. Means 628 also provides means to adjust the range of the capsule to vary the function of the momentary buoyant gate system. When the container is inverted, buoyant capsule 40 is prevented from rising into the container by means 628. When insert 500 is placed on container port 600, buoyant capsule 40 cannot escape from container port 600 and buoyant capsule 40 is thus retained within range between insert 500 and arcuate means 628. These arcuate means may be molded within the container.

Shoulder surface 604 of container port 600 provides a seat for insert 500. Either before or after the container is filled, buoyant capsule 624 can be inserted prior to placing insert 500 on shoulder 604. Insert 500 can be attached by any suitable means such as adhesives, radio waves, welding etc.

Figure 6:
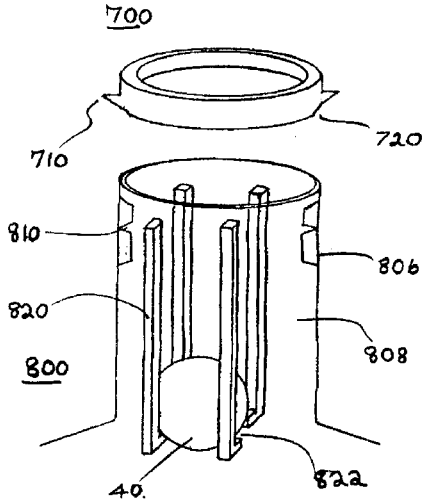
FIG. 6 shows a portion of an alternate embodiment of the momentary buoyant gate system of FIG. 1.

Referring now to FIG. 6, there is shown momentary buoyant gate insert 700 and container port 800. Insert 700 provides retaining means for preventing capsule 40 from exiting a container and for preventing a fluid tight seal as previously described or controlling the quality of the seal. When insert 700 and port 800 are used with an oil container they can control the flow of oil when the oil container is inverted as previously described. Ridges 820 or vertical rails 820 guide and contain buoyant capsule 40 and provide means for varying the inner diameter of throat 808 of the container. Shoulder 720 of insert 700 can rest against rails 820. Vertical rails 820 can be molded or attached to the inner surface of the container and can control the flow of fluid around buoyant capsule 40 to adjust the rate of fluid flow from the container. Vertical rails 820 can be provided with abutments 822 for preventing buoyant capsule 40 from falling into the body of the container as also previously described or providing means to control the capsule travel range which allows for customizing of function. Recesses 810 within relatively small ridges 806 can receive barbs 710 in order to secure insert 700 to the container.

Figure 7:
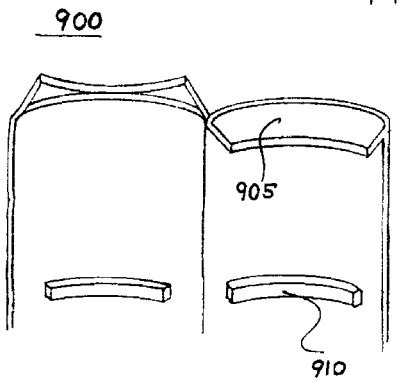
FIG. 7 shows a portion of an alternate embodiment of the momentary buoyant gate system of FIG. 1.

Referring now to FIG. 7, there is shown momentary buoyant gate system 900 having a living hinge. Momentary buoyant gate system 900 is provided with inwardly extending features 905, 910 for retaining buoyant capsule 40 therebetween. Feature 905 of system 900 can taper downwardly at a slight angle and can receive and retain barbs 710 of insert 700 in order to secure insert 700 to the container. Features 905 can be snapped downward to back together and provide the same function as insert 700. Feature 905 can also be molded in one piece to function like insert 700. Capsule 40, retained between features 905 and 910 in this manner, operates to control fluid flow in a manner similar to the manner described above. Buoyant capsule 40 can rest on features 910 when the container is disposed in an upright position.

Figure 8:
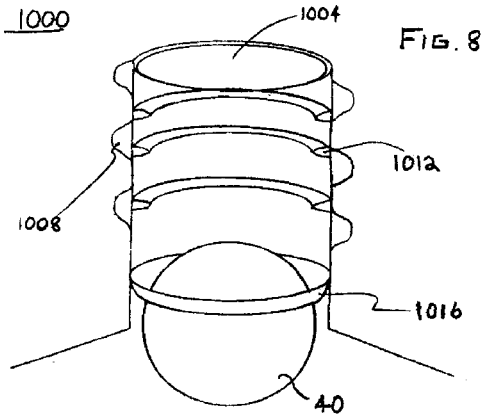
FIG. 8 shows a portion of an alternate embodiment of the momentary buoyant gate system of FIG. 1.

Referring now to FIG. 8, there is shown momentary buoyant gate system 1000 having opening 1004, threads 1008 and horizontal inner annular ridges 1012 or baffles 1012. Ridges 1012 or baffles 1012 can control the flow of oil or other fluid from the container when the container is disposed in an inverted position. Momentary buoyant gate system 1000 is also provided with inner annular restraining shoulder 1016 or restricting means 1016 for retaining buoyant capsule 40 when the container is inverted and allowing fluid within the container to seep around buoyant capsule 40 as previously described until buoyant capsule 40 is released. Alternatively, means 1016 can control the quality of seal. In the case of oil in a flexible bottle it may be desired to have more manual control by squeezing and releasing the bottle thus drawing the capsule inward to allow flow. Buoyant capsule 40 can be inserted into the container and retained within the container by forcing it past restricting means 1016. Although all of the embodiments of momentary buoyant gates described herein can be used with any containers for any kind of fluid, it will be understood that systems 500, 700, 900 and 1000 can be very advantageously applied to oil containers. These embodiments can also prevent unwanted gasses from escaping the container while in an upright position.

Although several preferred embodiments have been described and illustrated, as well as several variations thereon, the invention is not limited thereto and may be embodied otherwise within the scope of the following claims. For example, the abutments can be formed as part of the retainer as well as part of the ridge means and the vertical rails can be formed as part of the ridge means. A single closure can be formed including the retainer and means for gripping the lip of the container and the restriction can be understood to include the buoyant capsule.

I claim:

1. A novel fluid container system, comprising:

a container having a port at an upper end through which port fluid is permitted to pass for emptying the container;

a buoyant restricter adapted to permit leakage of fluid out of the port when the container is inverted thereby providing a leakable inverted buoyant restricter within the container for momentarily restricting fluid flow out of the port when the container is inverted, the restricter having a construction such that a restricted fluid flow is permitted through the port for a period of time when the container is inverted, after which period of time a substantially less restricted fluid flow is permitted through the port; and a retainer adapted to permit fluid flow therethrough when the container is inverted for controlling the travel range of the leakable inverted buoyant restricter.

2. The novel fluid container system as set forth in claim 1, wherein the retainer is disposed on an inner surface of both the closure and the upper end of the container and extends inwardly from the inner surface.

3. The novel fluid container system as set forth in claim 1, wherein the retainer comprises a substantially horizontal arcuate member.

4. The novel fluid container system as set forth in claim 1, wherein the retainer encloses a buoyant member.

5. The novel fluid container system as set forth in claim 1, wherein the retainer comprises at least one vertical member.

6. The novel fluid container system as set forth in claim 5, wherein the vertical member comprises an inwardly extending abutment for preventing the restricter from falling downwardly when the container is disposed in the upright position.

7. The novel fluid container system as set forth in claim 1, wherein the restricter includes a generally spherical, flexible and resilient ball which is buoyant in the fluid, which ball has a diameter greater than a diameter of the container system exit port.

8. The novel fluid container system as set forth in claim 6, wherein the vertical member is disposed on the inner surface of the container.

9. A fluid container for use in a fluid dispensing method that includes disposing the container in an inverted position to permit gravitational flow of fluid from the container, comprising:

a container port at an upper end of the container through which fluid passes for emptying the container;

a closure ridge on an inner surface of the container;

a buoyant restricter adapted to permit leakage of fluid out of the port when the container is inverted thereby providing a leakable inverted buoyant restricter, the leakable inverted buoyant restricter including a capsule for engaging the closure ridge and restricting fluid flow through the port until the buoyant characteristics of the capsule overcome engagement between the capsule and the closure ridge to permit the capsule to move upwardly and to permit a substantially less restricted fluid flow through the port; and a retainer adapted to permit fluid flow therethrough when the container is inverted for controlling the travel range of the leakable inverted buoyant restricter.

10. The fluid container of claim 9, wherein the retainer is disposed on an inner surface of the upper end of the container and extends inwardly from the inner surface.

11. The fluid container of claim 9, wherein the retainer comprises a substantially horizontal arcuate member.

12. The fluid container of claim 9, wherein the retainer comprises a circular member.

13. The fluid container of claim 9, wherein the retainer comprises at least one vertical member.

14. The fluid container of claim 13, wherein the vertical member comprises an inwardly extending abutment for preventing the restricter from falling downwardly when the container is disposed in the upright position.

15. The fluid container of claim 13, wherein the restricter includes a buoyant object which has a diameter greater than a diameter of the container exit port.

16. A novel fluid container system, comprising:

a container having a port at an upper end through which fluid passes to fill and empty the container;

a buoyant restricter adapted to permit leakage of fluid out of the port when the container is inverted thereby providing a leakable inverted buoyant restricter for momentarily restricting fluid flow through the port when the container is inverted, the leakable inverted buoyant restricter having a construction such that when the container is in an upright position fluid is permitted substantially free passage through the port until the container is substantially full at which time the port is substantially restricted by the leakable inverted buoyant restricter and, when the container is inverted, a restricted fluid flow is permitted through the port until an exterior blow is applied to the container to cause the leakable inverted buoyant restricter to disengage and permit a substantially unrestricted fluid flow through the port; and a retainer adapted to permit fluid flow therethrough when the container is inverted for retaining the leakable inverted buoyant restricter in the vicinity of the port.

17. The novel fluid container system as set forth in claim 16, wherein the restricter includes a generally buoyant object, wherein the object has a diameter greater than a diameter of the port, and wherein the restricter further includes engagement means disposed on the inner surface of the container system for preventing the generally buoyant object from forming a fluid-tight seal with the port.

18. The novel fluid container system as set forth in claim 17, wherein the engagement means includes a ridge for cooperating with the generally buoyant object when positioned in engagement with the port to restrict flow therethrough and defining a fluid passageway for controllably permitting leakage of fluid past the generally buoyant object when the container is inverted.

19. The novel fluid container system as set forth in claim 18, wherein the generally buoyant object is adapted to flexibly deform when engaged by the ridge.

20. The novel fluid container system as set forth in claim 16, wherein the container is generally cylindrical and the fluid port forms a bottle neck adapted to be placed within a fluid dispensing station when the container is inverted.

21. The novel fluid container system as set forth in claim 17, wherein the upper end of the container is tapered in order to facilitate positioning the generally buoyant object over the port to restrict fluid flow therethrough.

22. The novel fluid container system as set forth in claim 16, wherein the restricter disengages in the absence of an exterior blow to the container to permit substantially unrestricted fluid flow through the port when fluid pressure at the port is reduced sufficiently through leakage of fluid past the restricter.

23. A novel fluid container system having a rate of fluid flow, comprising:

a closure;

a retainer coupled to the closure and adapted to permit fluid flow therethrough when the container is inverted, said retainer having a buoyant restricter adapted to permit leakage of fluid out of the port when the container is inverted thereby providing a leakable inverted buoyant restricter; and the retainer having a ridge for preventing the leakable inverted buoyant restricter from becoming lodged in the closure and permitting the leakable inverted buoyant restricter to oscillate when the container is inverted to thereby determine the rate of fluid flow out of the container when the container is inverted.

24. The novel fluid container system of claim 23, wherein the restricter buoyantly rises after the container system is inverted.

25. The novel fluid container system of claim 24, wherein the ridge retains the restricter inside the container system after the container system is inverted.

26. The novel fluid container system of claim 23, further comprising a cap having a tear away seal wherein the cap is not removable by a user.

27. The novel fluid container system of claim 23, comprising vertically placed ridge means for adjusting the diameter of the restricter.

28. The novel fluid container system of claim 27, wherein the ridge control the motion of the restricter in all three dimensions for adapting the container system to differing liquids.

29. The novel fluid container system of claim 28, wherein the restricter periodically occludes the closure thereby defining a frequency and adjusting the ridge adjusts the frequency.

30. The novel fluid container system of claim 23, wherein the container system comprises an insert.

31. The novel fluid container system of claim 30, wherein the insert encloses the restricter for restricting fluid flow while the container is inverted.

32. The novel fluid container system of claim 30, wherein the insert comprises the ridge means for preventing the restricter from becoming lodged and for controlling a seal between the ridge and the restricter.

33. The novel fluid container system of claim 32, wherein the ridge controls the motion of the restricter in all three dimensions.

34. The novel fluid container system of claim 33, wherein the restricter occludes the closure with a frequency and adjusting the retainer, the ridge and the restricter adjusts the frequency and customizes the container system for differing fluids.

35. The novel fluid container system of claim 23, wherein the closure comprises means for opening an exit port of the closure without removing the closure from the container system.

36. The novel fluid container system of claim 23, wherein adjusting the ridge controls a fluid flow rate.

37. The novel fluid container system of claim 23, further comprising a plurality of baffles disposed in the interior surface of the container system for controlling the fluid flow.

38. The novel fluid container system of claim 29, wherein adjusting restricter properties adjusts the frequency.

* * * * *